US009958181B2

(12) United States Patent
Matsunaga et al.

(10) Patent No.: US 9,958,181 B2
(45) Date of Patent: May 1, 2018

(54) INDOOR UNIT FOR AIR-CONDITIONING APPARATUS

(71) Applicant: Mitsubishi Electric Corporation, Tokyo (JP)

(72) Inventors: Naoya Matsunaga, Tokyo (JP); Masaaki Maruyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 377 days.

(21) Appl. No.: 14/447,802

(22) Filed: Jul. 31, 2014

(65) Prior Publication Data

US 2015/0038068 A1 Feb. 5, 2015

(30) Foreign Application Priority Data

Aug. 5, 2013 (JP) ..... 2013-162535

(51) Int. Cl.
*F24F 13/08* (2006.01)
*F24F 13/14* (2006.01)
*F24F 1/00* (2011.01)

(52) U.S. Cl.
CPC ..... *F24F 13/08* (2013.01); *F24F 1/0011* (2013.01); *F24F 1/0014* (2013.01);
(Continued)

(58) Field of Classification Search
CPC ..... F24F 13/08; F24F 13/1413; F24F 13/148; F24F 1/0011; F24F 1/0014;
(Continued)

(56) References Cited

U.S. PATENT DOCUMENTS 2,972,358 A * 2/1961 Hinden ..... F24F 13/08 138/39
3,045,580 A * 7/1962 Johnson ..... F24F 13/075 454/313

(Continued)

FOREIGN PATENT DOCUMENTS

CN 204026848 U 12/2014
JP 63-018307 U 2/1988

(Continued)

OTHER PUBLICATIONS

Extended European Search Report dated Feb. 3, 2015 issued in corresponding EP patent application No. 14179214.3.

(Continued)

*Primary Examiner* — Gregory Huson
*Assistant Examiner* — Dana Tighe
(74) *Attorney, Agent, or Firm* — Posz Law Group, PLC

(57) ABSTRACT

An indoor unit of an air-conditioning apparatus includes vanes, vane shafts and, which are disposed at the ends of the vanes, vane bearings and, which hold the vane shafts and, and motors, each of which is mounted on a corresponding one of the vane shafts and each of which causes a corresponding one of the vanes to rotate. Each of the vane shafts is provided with a rib, and each of the vane bearings, which hold the corresponding vane shafts, is provided with a hook portion. When one of the vane shafts moves by a reference movement amount in a direction toward the corresponding vane shaft, the corresponding rib and the corresponding hook portion engage with each other, so that movement of the vane shaft is restricted.

4 Claims, 5 Drawing Sheets

(52) U.S. Cl.
CPC ..... *F24F 13/1413* (2013.01); *F24F 13/1486* (2013.01); *F24F 2001/0037* (2013.01)

(58) Field of Classification Search
CPC ..... F24F 2001/00376; F24F 13/1486; F24F 2001/0037
USPC ..... 454/284
See application file for complete search history.

(56) References Cited

U.S. PATENT DOCUMENTS

| | | | | |
|---|---|---|---|---|
| 3,996,845 | A * | 12/1976 | Harris | B23P 11/00 454/320 |
| 5,443,420 | A * | 8/1995 | Kim | F24F 1/0011 251/129.1 |
| 2015/0038068 | A1 | 2/2015 | Matsunaga et al. | |

FOREIGN PATENT DOCUMENTS

| | | | |
|---|---|---|---|
| JP | 2003-014286 | A | 1/2003 |
| JP | 2006-177609 | A | 7/2006 |
| JP | 2007-093040 | A | 4/2007 |
| JP | 2009-198133 | A | 9/2009 |
| JP | 2012-193933 | A | 10/2012 |
| WO | 2013/054537 | A1 | 4/2013 |

OTHER PUBLICATIONS

Office Action dated Dec. 8, 2015 in the corresponding JP application No. 2013-162535 (with English translation).
Office Action dated Jul. 6, 2016 issued in corresponding CN patent application No. 201410377522.3 (and English machine translation).
Communication Pursuant to Article 94(3) EPC of May 10, 2017 for corresponding EP application No. 14 179 214.3.

* cited by examiner

INDOOR UNIT FOR AIR-CONDITIONING APPARATUS

TECHNICAL FIELD

The present invention relates to an indoor unit of an air-conditioning apparatus.

BACKGROUND ART

In the related art, there is a bathroom heater that includes an air outlet unit, which includes a frame member and a motor-accommodating box, the frame member including a bearing portion and having an air outlet formed therein, and the motor-accommodating box being connected to the frame member, a wind-direction-adjusting louver that includes pivot shafts on the left and right sides thereof and that is rotatably supported by the frame member, and a stepping motor for driving the louver that is accommodated in the motor-accommodating box (see, for example, Patent Literature 1). In the bathroom heater described in Patent Literature 1, pivot shafts of a wind-direction-adjusting louver are connected to a drive shaft of a stepping motor.

CITATION LIST

Patent Literature

[Patent Literature 1] Japanese Unexamined Patent Application Publication No. 2003-14286 (p. 3, FIG. 5)

SUMMARY OF INVENTION

Technical Problem

However, in the bathroom heater described in Patent Literature 1, there has been a problem in that in the case where one of the pivot shafts of the wind-direction-adjusting louver (a vane) that receives a rotational force from the stepping motor (a motor) breaks before the other one of the pivot shafts of the vane breaks, the other one of the pivot shafts of the vane cannot support the weight of the vane that acts in a direction in which the vane falls, and the vane falls into an indoor space.

The present invention has been made in the context of a problem such as that described above, and it is an object of the present invention to obtain an indoor unit of an air-conditioning apparatus capable of suppressing occurrence of falling of a vane without deteriorating operation efficiency.

Solution to Problem

An indoor unit of an air-conditioning apparatus according to the present invention includes a vane, vane shafts that are disposed at ends of the vane, vane bearings each of which holds a corresponding one of the vane shafts, and a motor that is attached to one of the vane shafts and that causes the vane to rotate. Another one of the vane shafts includes a vane shaft side engagement portion. The vane bearing that holds the other one of the vane shafts includes a vane bearing side engagement portion. When the other one of the vane shafts moves by a reference movement amount in a direction toward the one of the vane shafts, the vane shaft side engagement portion and the vane bearing side engagement portion engage with each other, and movement of the other one of the vane shafts is restricted.

Advantageous Effects of Invention

According to the present invention, when one of vane shafts moves by a reference movement amount in a direction toward the other one of the vane shafts, a vane shaft side engagement portion and a vane bearing side engagement portion engage with each other, and movement of the one of the vane shafts is restricted. Therefore, even if one of the vane shafts that receives a rotational force from a motor breaks due to, for example, crazing, occurrence of falling of the vane can be suppressed. In addition, since the vane shaft side engagement portion is included in one of the vane shafts, and the vane bearing side engagement portion is included in a vane bearing, a structure that suppresses occurrence of falling of the vane is formed of only components of the related art, and operation efficiency will not deteriorate.

DESCRIPTION OF EMBODIMENT

A four-way cassette type indoor unit of an air-conditioning apparatus will be described below as an example of an air-conditioning apparatus according to Embodiment of the present invention. Note that the present invention is not limited to Embodiment, which will be described below. In addition, although in the following description, terms (e.g., "top", "bottom", and the like) that represent locations will be suitably used for ease of understanding, this is for the sake of explanation, and these terms do not limit the present invention.

Figure 1:
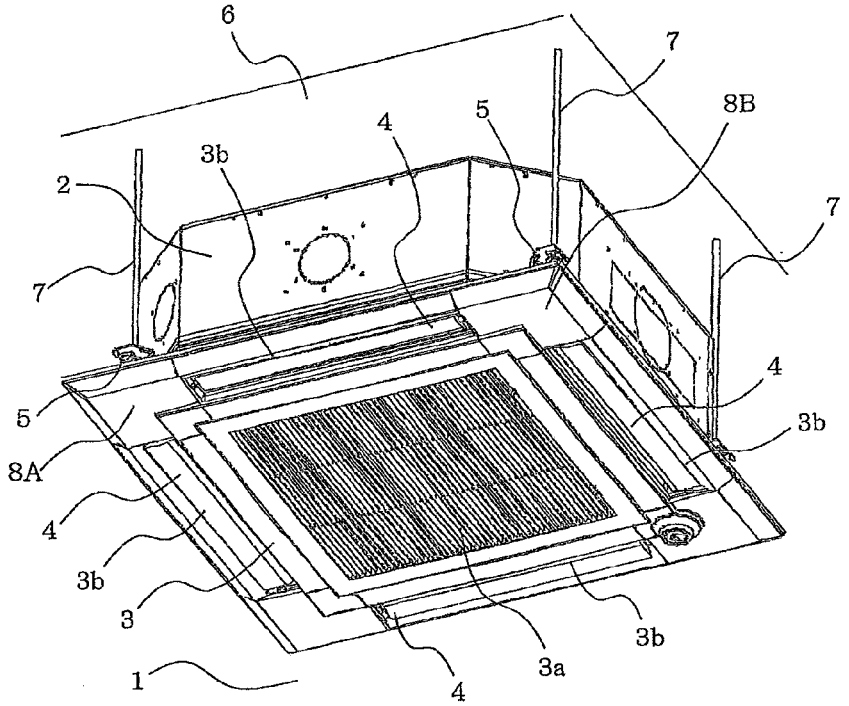
FIG. 1 is a perspective view illustrating an installation state of an indoor unit 100 of an air-conditioning apparatus according to Embodiment.
Figure 2:
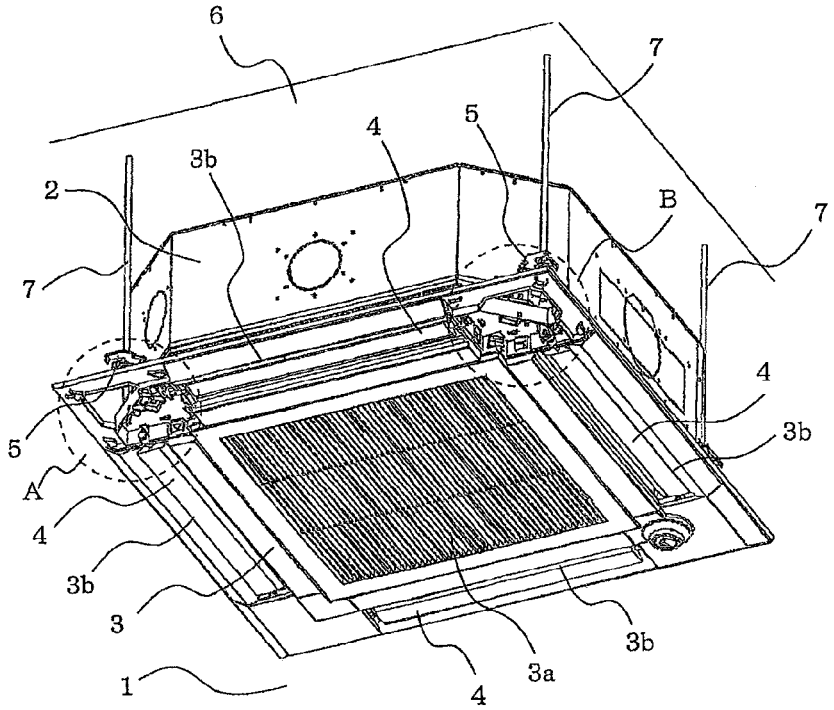
FIG. 2 is a perspective view illustrating the indoor unit 100 for the air-conditioning apparatus according to Embodiment and illustrating a state where decorative-panel-corner-cover members 8A and 8B have been removed.

FIG. 1 is a perspective view illustrating an installation state of an indoor unit 100 for the air-conditioning apparatus according to Embodiment. FIG. 2 is a perspective view illustrating the indoor unit 100 for the air-conditioning apparatus according to Embodiment and illustrating a state where decorative-panel-corner-cover members 8A and 8B have been removed.

As illustrated in FIG. 1, the indoor unit 100 for the air-conditioning apparatus includes a housing 2 in an indoor space 1. Four hanging bolts 7 are bolted to a ceiling 6. The housing 2 is mounted on the ceiling 6 by fastening hanging metal fittings 5 onto any points on the hanging bolts 7. The housing 2 is attached to the hanging bolts 7 at, for example, four points on an outline of the housing 2.

The housing 2 accommodates an indoor-air-sending device (not illustrated) and an indoor-unit-heat exchanger (not illustrated) that exchanges heat for indoor air. A suction grille 3*a* and air outlets 3*b* are formed on a bottom surface of the housing 2. The suction grille 3*a* is disposed at the center of the bottom surface of the housing 2. The air outlets 3*b* are formed around the suction grille 3*a*. Vanes 4 each of which has, for example, a flat plate-like shape are disposed in the air outlets 3*b*. The vanes 4 adjust the volume of air that flows from an area inside the indoor unit 100 toward an indoor space through the air outlets 3*b* and guide the direction of the air.

A decorative panel 3 is attached on the bottom surface of the housing 2. The decorative panel 3 includes the decorative-panel-corner-cover members 8A and 8B each of which is removable. In the state illustrated in FIG. 1, in the case where the decorative-panel-corner-cover members 8A and 8B are removed, various components are exposed as illustrated in FIG. 2. Details of the various components will be described later. Note that, a portion from which the decorative-panel-corner-cover member 8A has been removed is a portion that is surrounded by a dotted line frame A illustrated in FIG. 2. Similarly, a portion from which the decorative-panel-corner-cover member 8B has been removed is a portion that is surrounded by a dotted line frame B illustrated in FIG. 2.

Figure 3:
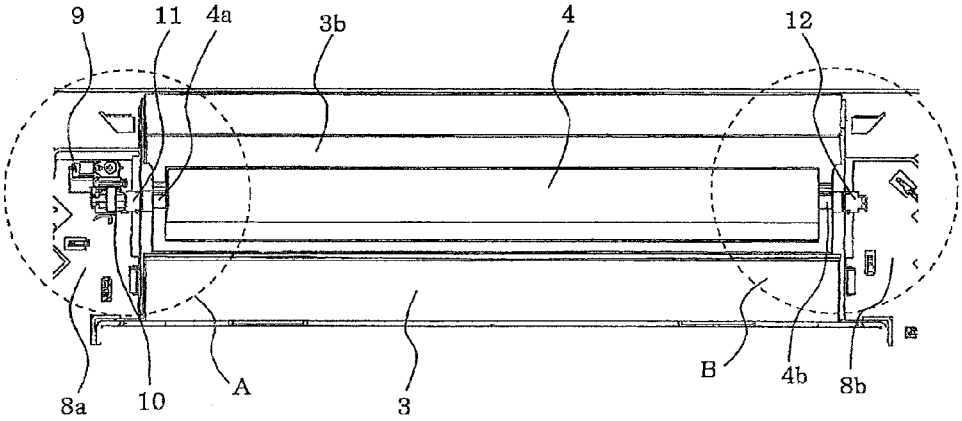
FIG. 3 is an enlarged view of an area in the vicinity of one of vanes 4 in a state where the decorative-panel-corner-cover members 8A and 8B of the indoor unit 100 for the air-conditioning apparatus according to Embodiment have been removed.

FIG. 3 is an enlarged view of an area in the vicinity of one of the vanes 4 in a state where the decorative-panel-corner-cover members 8A and 8B of the indoor unit 100 for the air-conditioning apparatus according to Embodiment have been removed. Here, a portion that is surrounded by a dotted line frame A illustrated in FIG. 3 is obtained by enlarging the portion that is surrounded by the dotted line frame A illustrated in FIG. 2. Similarly, a portion that is surrounded by a dotted line frame B illustrated in FIG. 3 is obtained by enlarging the portion that is surrounded by the dotted line frame B illustrated in FIG. 2. As illustrated in FIG. 3, one of the vanes 4 includes a vane shaft 4*a* and a vane shaft 4*b*.

The vane shaft 4*a* is disposed at one end of the vane 4. A decorative-panel-corner portion 8*a*, a motor 9, a vane gear 10, and a vane bearing 11 are disposed in the vicinity of the vane shaft 4*a*. The decorative-panel-corner portion 8*a*, the motor 9, the vane gear 10, and the vane bearing 11 are members that are exposed by removing the decorative-panel-corner-cover member 8A. The decorative-panel-corner portion 8*a* is a wall surface a portion of which is an opening into which the vane bearing 11 is to be inserted. The vane bearing 11 is a member into which the vane shaft 4*a* is to be inserted.

The vane shaft 4*b* is disposed at the other end of the vane 4. A decorative-panel-corner portion 8*b* and a vane bearing 12 are disposed in the vicinity of the vane shaft 4*b*. The decorative-panel-corner portion 8*b* and the vane bearing 12 are members that are exposed by removing the decorative-panel-corner-cover member 8B. The decorative-panel-corner portion 8*b* is a wall surface a portion of which is an opening into which the vane bearing 12 is to be inserted. The vane bearing 12 is a member into which the vane shaft 4*b* is to be inserted.

Figure 4:
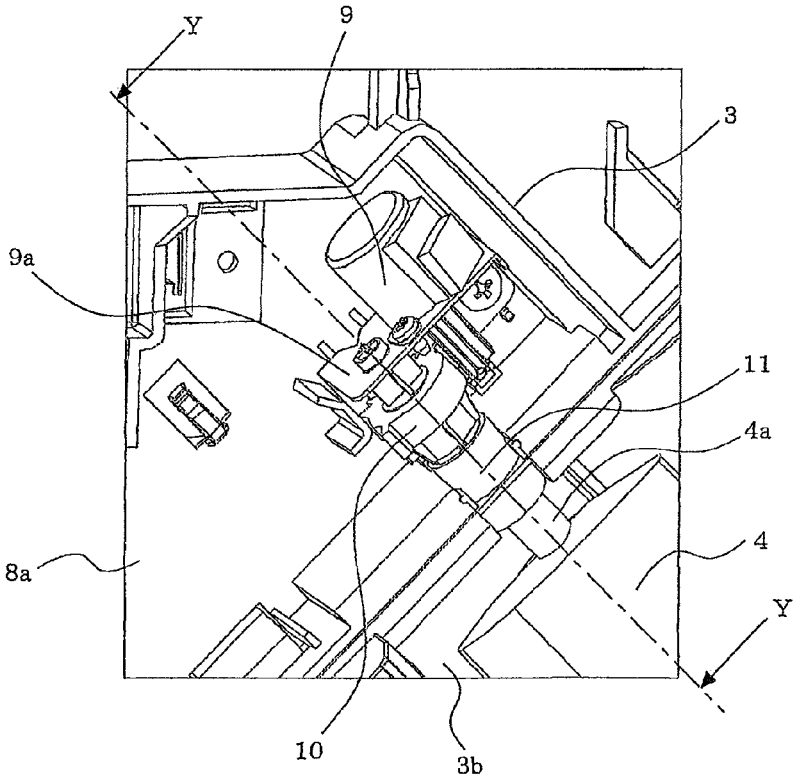
FIG. 4 is a perspective view illustrating an area in the vicinity of one of vane shafts 4*a* of the indoor unit 100 for the air-conditioning apparatus according to Embodiment.
Figure 5:
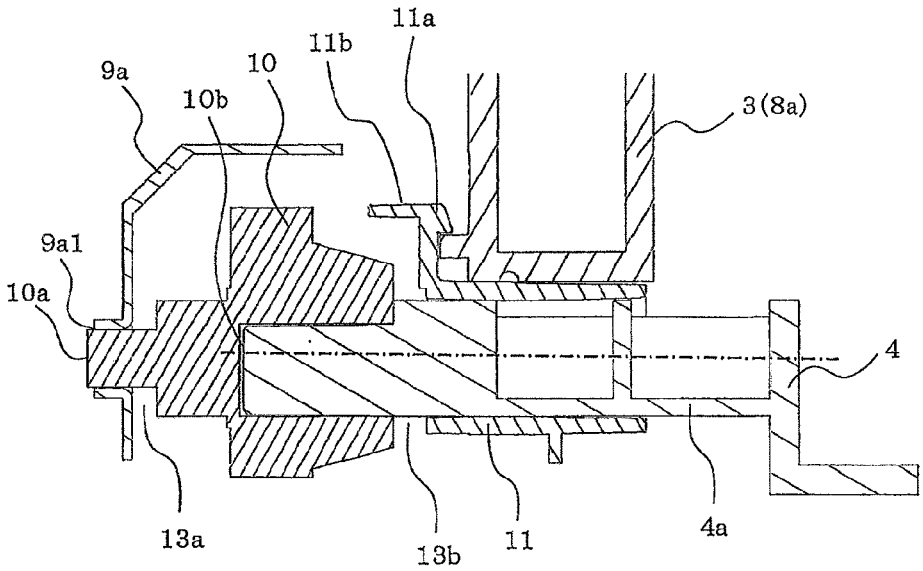
FIG. 5 is a sectional view taken along line Y-Y of FIG. 4.

FIG. 4 is a perspective view illustrating an area in the vicinity of one of the vane shafts 4*a* of the indoor unit 100 for the air-conditioning apparatus according to Embodiment. FIG. 5 is a sectional view taken along line Y-Y of FIG. 4.

As illustrated in FIG. 4, the motor 9 is a member that is used for causing the vane 4 to rotate. The rotational force of the motor 9 is to be transmitted to the vane shaft 4*a*. The vane 4 rotates about the vane shaft 4*a* with rotation of the motor 9. A motor-holding sheet metal 9*a* that holds the motor 9 is mounted on the motor 9.

As illustrated in FIG. 5, the vane gear 10 is a member that includes a convex vane gear shaft 10*a* and a recess 10*b*. The vane gear shaft 10*a* is a member that is to be inserted into a hole 9*a*1 that is formed in the motor-holding sheet metal 9*a*. The recess 10*b* is a portion into which an end portion of the vane shaft 4*a* is to be pressed and fitted. The vane bearing 11 includes a hook portion 11*a* and a flange 11*b*.

The hook portion 11*a* is a member that is used for causing the vane bearing 11 to be held by the decorative panel 3 and protrudes toward the side on which the decorative-panel-corner portion 8*a* is present. The flange 11*b* protrudes toward the side on which the vane gear 10 is present. A gap 13*a* is defined between the motor-holding sheet metal 9*a* and the vane gear 10. A gap 13*b* is defined between the vane gear 10 and the vane bearing 11.

A procedure of assembling members that are positioned at the side on which one of the vane shafts 4*a* of the indoor unit 100 for the air-conditioning apparatus is present will be described below.

First, the vane shaft 4*a* is inserted into the vane bearing 11, and an end portion of the vane shaft 4*a* is pressed and fitted into the recess 10*b* of the vane gear 10. Next, the vane gear shaft 10*a* is inserted into the hole 9*a*1. The position of the corresponding vane 4 after the assembling operation is set by inserting the vane shaft 4*a* into the recess 10*b* of the vane gear 10 so as to make contact with the bottom of the recess 10*b* as described above. An amount of movement of the vane 4 in an axial direction of the vane 4 after the assembling operation is determined in accordance with the gap 13*a* and the gap 13*b*.

Figure 6:
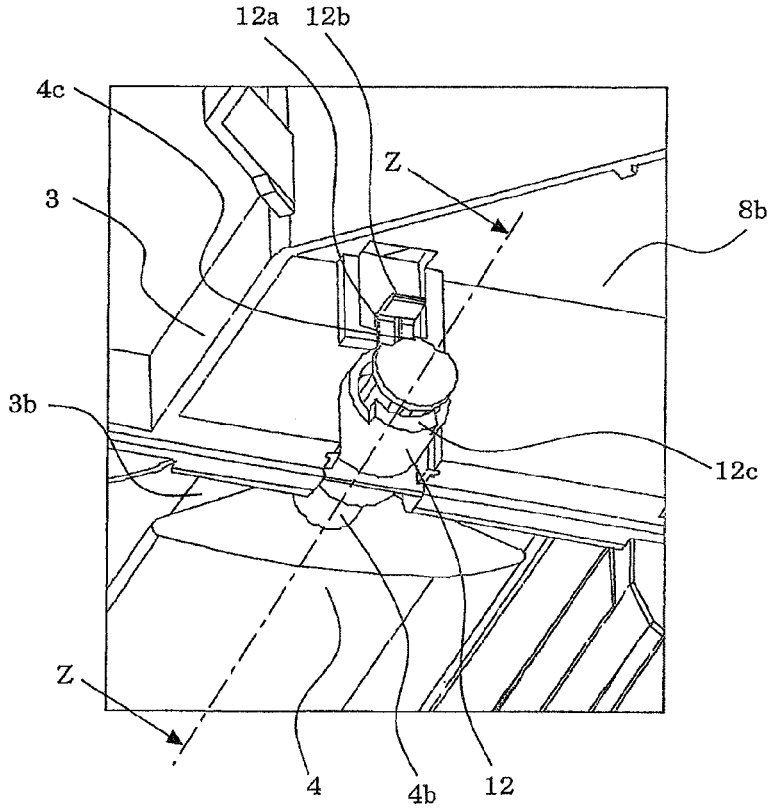
FIG. 6 is a perspective view illustrating an area in the vicinity of one of vane shafts 4*b* at the time of assembling the indoor unit 100 for the air-conditioning apparatus according to Embodiment.
Figure 7:
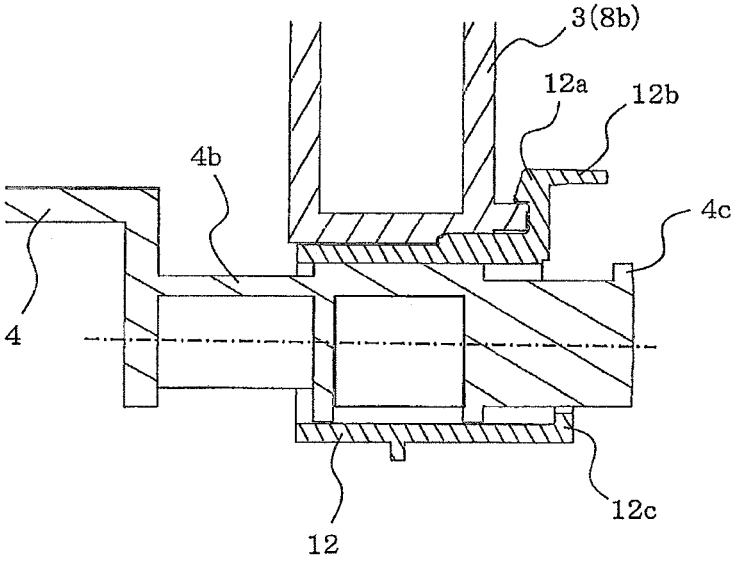
FIG. 7 is a sectional view taken along line Z-Z of FIG. 6.
Figure 8:
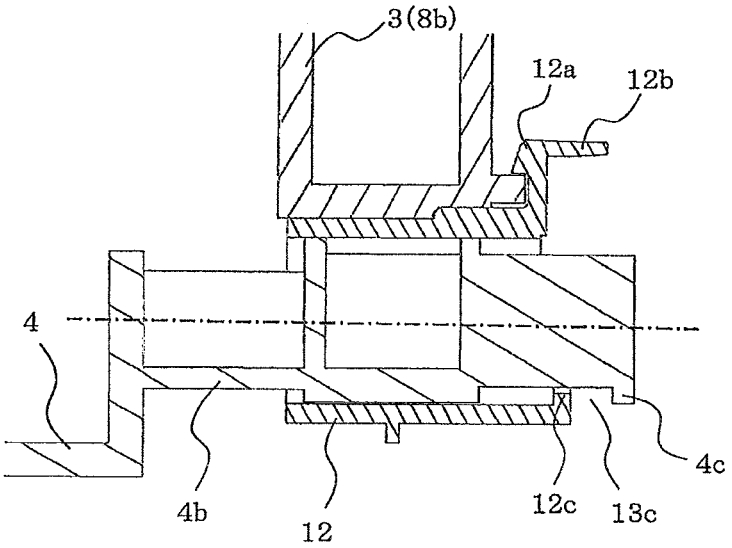
FIG. 8 is a sectional view illustrating an area in the vicinity of one of the vane shafts 4*b* at the time of product shipment of the indoor unit 100 for the air-conditioning apparatus according to Embodiment.
Figure 9:
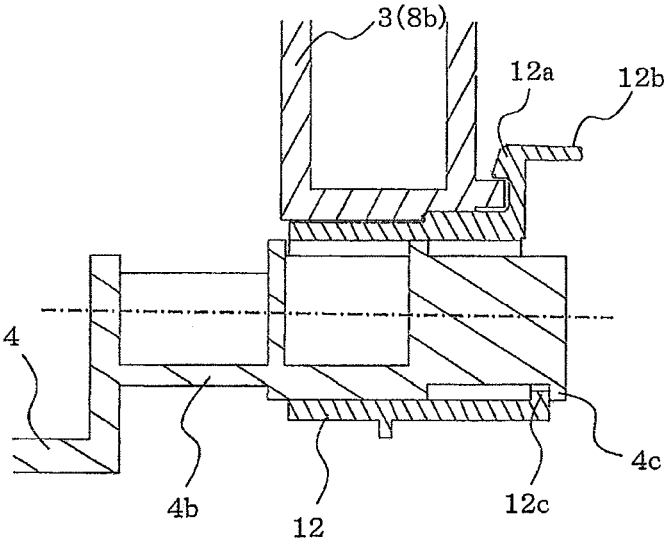
FIG. 9 is a sectional view illustrating an area in the vicinity of one of the vane shafts 4*b* of the indoor unit 100 for the air-conditioning apparatus according to Embodiment and illustrating a state where the vane 4 has fallen.

FIG. 6 is a perspective view illustrating an area in the vicinity of one of the vane shafts 4*b* at the time of assembling the indoor unit 100 for the air-conditioning apparatus according to Embodiment. FIG. 7 is a sectional view taken along line Z-Z of FIG. 6. FIG. 8 is a sectional view illustrating an area in the vicinity of one of the vane shafts 4*b* at the time of product shipment of the indoor unit 100 for the air-conditioning apparatus according to Embodiment. FIG. 9 is a sectional view illustrating an area in the vicinity of one of the vane shafts 4*b* of the indoor unit 100 for the air-conditioning apparatus according to Embodiment and illustrating a state where the vane 4 has fallen.

As illustrated in FIG. 6, the vane shaft 4*b* includes a rib 4*c* that has, for example, a fan-like shape. At the time of the assembling operation, the rib 4*c* is arranged in such a manner as to, for example, protrude upward. The vane bearing 12 includes a hook portion 12*a*, a flange 12*b*, and a hook portion 12*c*. The hook portion 12*a* protrudes toward the side on which the decorative-panel-corner portion 8*b* is present. The flange 12*b* protrudes toward the side opposite to that on which the decorative-panel-corner portion 8*b* is present. The flange 12*b* is configured to be deflectable in a direction in which the weight of the flange 12*b* acts. Since the flange 12*b* is configured as described above, the vane bearing 12 can be easily removed from the decorative panel 3, and maintenance can be facilitated. The hook portion 12*c* is arranged in such a manner as to, for example, protrude upward.

As illustrated in FIG. 7, the vane shaft 4*b* is inserted into the vane bearing 12 in a state where, for example, the rib 4*c* protrudes upward. Thus, the rib 4*c*, which has a fan-like shape, can avoid the hook portion 12*c*, and the vane shaft 4*b* can be inserted without the rib 4*c* and the hook portion 12*c* contacting each other.

A procedure of assembling members that are positioned at the side on which one of the vane shafts 4*b* of the indoor unit 100 for the air-conditioning apparatus is present will be described below.

First, the vane shaft 4*b* is inserted into the vane bearing 12. Next, the vane bearing 12 is inserted into the decorative-panel-corner portion 8*b*. In this manner, the vane 4 is held by the decorative-panel-corner portion 8*b*. In other words, the vane 4 is held by the decorative panel 3. As a result of the hook portion 12*a* being hooked on the decorative-panel-corner portion 8*b*, the vane bearing 12 is held by the decorative panel 3. The vane shaft 4*b* is positioned as illustrated in FIG. 8 at the time of product shipment by being rotated 180 degrees.

As illustrated in FIG. 8, at the time of product shipment, an end of the rib 4*c* faces the direction in which the weight of the rib 4*c* acts, and the rib 4*c* and the hook portion 12*c* are disposed in such a manner as to be superposed with each other in the axial direction. In this case, the hook portion 12*c* is positioned further toward the side on which the vane shaft 4*a* is present than the rib 4*c*, and a gap 13*c* is defined between the rib 4*c* and the hook portion 12*c*.

The gap 13*c* is designed in such a manner as to be larger than the gap 13*a*. Thus, even if the vane 4 moves in such a manner that the gap 13*a* is eliminated in a normal operation, the gap 13*c* will not be eliminated, and the rib 4*c* and the hook portion 12*c* will not interfere with each other. Therefore, the slidability of the vane shaft 4*b* and the vane bearing 12 and the drive stability of the vane 4 will not be impaired.

Operation of the indoor unit 100 for the air-conditioning apparatus in the case where one of the vane shafts 4*a* breaks will be described below.

First, when the vane shaft 4*a* (FIG. 5) that receives the rotational force of the motor 9 breaks, the vane 4 moves in the left direction as viewed in FIG. 9 and has a tendency to fall into the indoor space 1 under its own weight. Then, in a state where the vane 4 has moved by a predetermined amount (a reference movement amount), the rib 4*c* and the hook portion 12*c* engage with each other, so that movement of the vane shaft 4*a* is restricted. As a result, falling of the vane 4 is controlled.

Note that increasing the size of the rib 4*c*, which has a fan-like shape, facilitates the engagement of the rib 4*c* and the hook portion 12*c* when the vane shaft 4*a* breaks during the period when the indoor unit 100 is operating. However, in the case where the size of the rib 4*c*, which has a fan-like shape, is excessively large, the rib 4*c* hinders insertion of the vane shaft 4*b* into the vane bearing 12. Therefore, it is desirable to design the rib 4*c*, which has a fan-like shape, in such a manner that the size of the rib 4*c* is not excessively large.

As described above, the indoor unit 100 for the air-conditioning apparatus according to Embodiment includes the vanes 4, the vane shafts 4*a* and 4*b*, which are disposed at the ends of the vanes 4, the vane bearings 11 and 12, which hold the vane shafts 4*a* and 4*b*, and the motors 9, each of which is mounted on the corresponding vane shaft 4*a* and each of which causes the corresponding vane 4 to rotate. Each of the vane shafts 4*b* is provided with the rib 4*c*, and each of the vane bearings 12, which hold the corresponding vane shafts 4*b*, is provided with the hook portion 12*c*. When one of the vane shafts 4*b* moves by a reference movement amount in a direction toward the corresponding vane shaft 4*a*, the corresponding rib 4*c* and the corresponding hook portion 12*c* engage with each other, so that movement of the vane shaft 4*b* is restricted.

Therefore, even if the vane shaft 4*a*, which receives the rotational force of the motor 9 breaks due to crazing or the like, occurrence of falling of the vane 4 can be suppressed. In addition, since the rib 4*c* is included in the vane shaft 4*b*, and the hook portion 12*c* is included in the vane bearing 12, a structure that suppresses the occurrence of falling of the vane 4 is formed of only components of the related art, and operation efficiency will not deteriorate. Therefore, the indoor unit 100 for the air-conditioning apparatus in which an assembly or removal operation can be easily performed can be obtained.

Note that each of the ribs 4*c* corresponds to a vane shaft side engagement portion of the present invention.

In addition, each of the hook portions 12*c* corresponds to a vane bearing side engagement portion of the present invention.

REFERENCE SIGNS LIST

1 indoor space 2 housing 3 decorative panel 3*a* suction grille 3*b* air outlet 4 vane 4*a* vane shaft 4*b* vane shaft 4*c* rib 5 hanging metal fitting 6 ceiling 7 hanging bolt 8A decorative-panel-corner-cover member 8B decorative-panel-corner-cover member 8*a* decorative-panel-corner portion 8*b* decorative-panel-corner portion 9 motor 9*a* motor-holding sheet metal 9*a*1 hole 10 vane gear 10*a* vane gear shaft 10*b* recess 11 vane bearing 11*a* hook portion 11*b* flange 12 vane bearing 12*a* hook portion 12*b* flange 12*c* hook portion 13*a* gap 13*b* gap 13*c* gap 100 indoor unit

The invention claimed is:

1. An indoor unit for an air-conditioning apparatus comprising:

a vane assembled within the air-conditioning apparatus;

first and second vane shafts that are disposed at opposing ends of the vane, the second vane shaft including a vane shaft side engagement portion;

a first vane bearing holding the first vane shaft;

a motor attached to the first vane shaft and configured to rotate the vane; and a second vane bearing holding the second vane shaft and including a vane bearing side engagement portion, wherein the vane shaft side engagement portion and the vane bearing side engagement portion include a configuration that prevents the vane from being displaced from the air-conditioning apparatus, the configuration including the vane shaft side engagement portion being positioned at a gap of fixed distance from the vane bearing side engagement portion and being aligned to engage the vane bearing side engagement portion by movement of the second vane shaft in a direction toward the first vane shaft and in an amount equal to the gap of fixed distance.

2. The indoor unit for an air-conditioning apparatus of claim 1, wherein, in a state where the first vane shaft is held by the first vane bearing and the second vane shaft is held by the second vane bearing, the vane bearing side engagement portion is positioned further toward a side on which the first vane shaft is present than the vane shaft side engagement portion.

3. The indoor unit for an air-conditioning apparatus of claim 1, wherein the vane shaft side engagement portion is a rib that has a fan-like shape.

4. The indoor unit for an air-conditioning apparatus of claim 1, wherein, in a state where the second vane shaft is inserted into the second vane bearing, the vane shaft side engagement portion and the vane bearing side engagement portion are unconnected to each other.

* * * * *